US011313202B2

(12) United States Patent
Gao et al.

(10) Patent No.: US 11,313,202 B2
(45) **Date of Patent: *Apr. 26, 2022**

(54) SYSTEMS AND METHODS FOR CONTROLLING FLUID FLOW IN A WELLBORE USING A SWITCHABLE DOWNHOLE CROSSOVER TOOL

(71) Applicant: Halliburton Energy Services, Inc., Houston, TX (US)

(72) Inventors: Bo Gao, Spring, TX (US); Lonnie C. Helms, Humble, TX (US); Aniruddha Gadre, The Woodlands, TX (US); Yuzhu Hu, Spring, TX (US); Gary Makowiecki, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/319,779

(22) PCT Filed: Sep. 23, 2016

(86) PCT No.: PCT/US2016/053449
§ 371 (c)(1),
(2) Date: Jan. 22, 2019

(87) PCT Pub. No.: WO2018/057000
PCT Pub. Date: Mar. 29, 2018

(65) Prior Publication Data

US 2019/0169958 A1 Jun. 6, 2019

(51) Int. Cl.
*E21B 33/14* (2006.01)
*E21B 34/10* (2006.01)
(Continued)

(52) U.S. Cl.
CPC ..... *E21B 33/14* (2013.01); *E21B 21/10* (2013.01); *E21B 34/10* (2013.01); *E21B 43/045* (2013.01); *E21B 2200/06* (2020.05)

(58) Field of Classification Search
CPC ..... E21B 33/14; E21B 21/10; E21B 34/10; E21B 43/045; E21B 2200/06
See application file for complete search history.

(56) References Cited

U.S. PATENT DOCUMENTS 4,565,213 A * 1/1986 Giebeler ..... E21B 34/10 137/494
4,583,593 A * 4/1986 Zunkel ..... E21B 23/04 166/131
(Continued)

FOREIGN PATENT DOCUMENTS

WO 2014169166 10/2014
WO 2015038119 3/2015
WO 2015038171 3/2015

OTHER PUBLICATIONS

International Search Report and Written Opinion of PCT Application No. PCT/US2016/053449 dated Jun. 15, 2017: pp. 1-16.

*Primary Examiner* — Christopher J Sebesta
*Assistant Examiner* — Neel Girish Patel
(74) *Attorney, Agent, or Firm* — Chamberlain Hrdlicka

(57) ABSTRACT

A system, method, and tool for controlling fluid in a wellbore. The system comprises a tubing string locatable in the wellbore and a crossover tool for enabling reverse circulation in the wellbore. The crossover tool comprises a tool body, a sleeve, a drag block assembly, and a packer assembly. The tool body comprises a bore in fluid communication with the tubing string and a valve in the bore. The sleeve is located in the tool body and controls the valve based on the axial position of the sleeve in the tool body. The drag block assembly is coupled to the sleeve through the tool body and
(Continued)

engages the wellbore to resist axial movement of the sleeve relative to the tool body. The packer assembly is coupled to the tool body and creates a fluid barrier in the annulus formed between the tubing string and the wellbore.

19 Claims, 9 Drawing Sheets

(51) Int. Cl.
*E21B 21/10* (2006.01)
*E21B 43/04* (2006.01)

(56) References Cited

U.S. PATENT DOCUMENTS 4,606,408 A * 8/1986 Zunkel ..... E21B 43/04 166/278
4,627,488 A * 12/1986 Szarka ..... E21B 43/04 166/142
6,250,383 B1 * 6/2001 Patel ..... E21B 21/10 166/70
7,857,052 B2 12/2010 Giroux et al.
8,695,709 B2 4/2014 Zimmerman et al.
2005/0103495 A1 * 5/2005 Corbett ..... E21B 34/14 166/278
2008/0128130 A1 * 6/2008 Whitsitt ..... E21B 23/04 166/278
2009/0050335 A1 2/2009 Mandrou
2013/0032397 A1 2/2013 Dirksen
2013/0068472 A1 * 3/2013 Lauderdale ..... E21B 34/14 166/373
2013/0075108 A1 * 3/2013 Frisby ..... E21B 34/14 166/373
2013/0192848 A1 * 8/2013 Patel ..... E21B 34/06 166/373
2014/0034336 A1 * 2/2014 Jasek ..... E21B 43/04 166/387
2014/0305662 A1 10/2014 Giroux et al.
2015/0047837 A1 * 2/2015 Turner ..... E21B 43/14 166/254.2
2016/0160603 A1 * 6/2016 Sevadjian ..... E21B 34/14 166/288
2017/0218710 A1 * 8/2017 Zhou ..... E21B 21/103

* cited by examiner

SYSTEMS AND METHODS FOR CONTROLLING FLUID FLOW IN A WELLBORE USING A SWITCHABLE DOWNHOLE CROSSOVER TOOL

This section is intended to provide relevant contextual information to facilitate a better understanding of the various aspects of the described embodiments. Accordingly, it should be understood that these statements are to be read in this light and not as admissions of prior art.

In oil field recovery operations, a casing, in the form of a steel pipe, or the like, is often placed in an oil and gas well to stabilize the well bore. In these installations, a cement sheath is formed in the annulus between the casing and the wall of the wellbore to support the casing, to prevent migration of fluids in the annulus, and to protect the casing from corrosive formation fluids.

Cementing of a casing string is often accomplished by pumping a cement slurry down the inside of a tubing or a casing, and then back up the annular space around the casing. In this way, a cement slurry may be introduced into the annular space of the casing (e.g. the annular space between the casing to be cemented and the open hole or outer casing to which the casing is to be cemented). This circulation direction is often referred to as a conventional circulation direction.

Though conventional circulation methods are the methods most commonly used for pumping cement compositions into well bores, these methods may be problematic in certain circumstances. For instance, a well bore may comprise one or more weak formations therein that may be unable to withstand the pressure commonly associated with conventional circulation cementing operations. The formation may breakdown under the hydrostatic pressure applied by the cement, thereby causing the cement to be lost into the subterranean formation. This may cause the undesirable loss of large amounts of cement into the subterranean formation. The loss of cement into the formation is undesirable, among other things, because of the expense associated with the cement lost into the formation. Likewise, high delivery pressures can cause the undesirable effect of inadvertently "floating" the casing string. That is, exposing the bottom hole of the well bore to high delivery pressures can, in some cases, cause the casing string to "float" upward. Moreover, the equivalent circulating density of the cement may be high, which may lead to problems, especially in formations with known weak or lost circulation zones.

Another method of cementing casing, sometimes referred to as reverse circulation cementing, involves introducing the cement slurry into the annular space rather than introducing the cement slurry down the casing string itself. In particular, reverse circulation cementing avoids the higher pressures necessary to lift the cement slurry up the annulus. Other disadvantages of having to pump the cement slurry all the way down the casing string and then up the annulus are that it requires a much longer duration of time than reverse circulation cementing. This increased job time is disadvantageous because of the additional costs associated with a longer duration cementing job. Moreover, the additional time required often necessitates a longer set delay time, which may require additional cement retarders or other chemicals to be added to the cement slurry.

A crossover tools enables reverse circulation from an internal flow path of a tool string into the annulus area to be cemented. With a crossover tool, the reverse circulation can be applied at any point along the wellbore, for example cementing a liner hanger and its liner in the wellbore.

However, crossover tools cannot switch the flow path back to a conventional circulation direction.

DESCRIPTION OF THE DRAWINGS

For a detailed description of the embodiments, reference will now be made to the accompanying drawings in which.

DETAILED DESCRIPTION

The present disclosure provides a crossover tool for enabling reverse circulation in a well. The crossover tool is switchable between conventional circulation and reverse circulation as needed to accommodate different stages of a cementing operation, separating fluids in the well, or controlling fluid circulation in the well.

Figure 1:
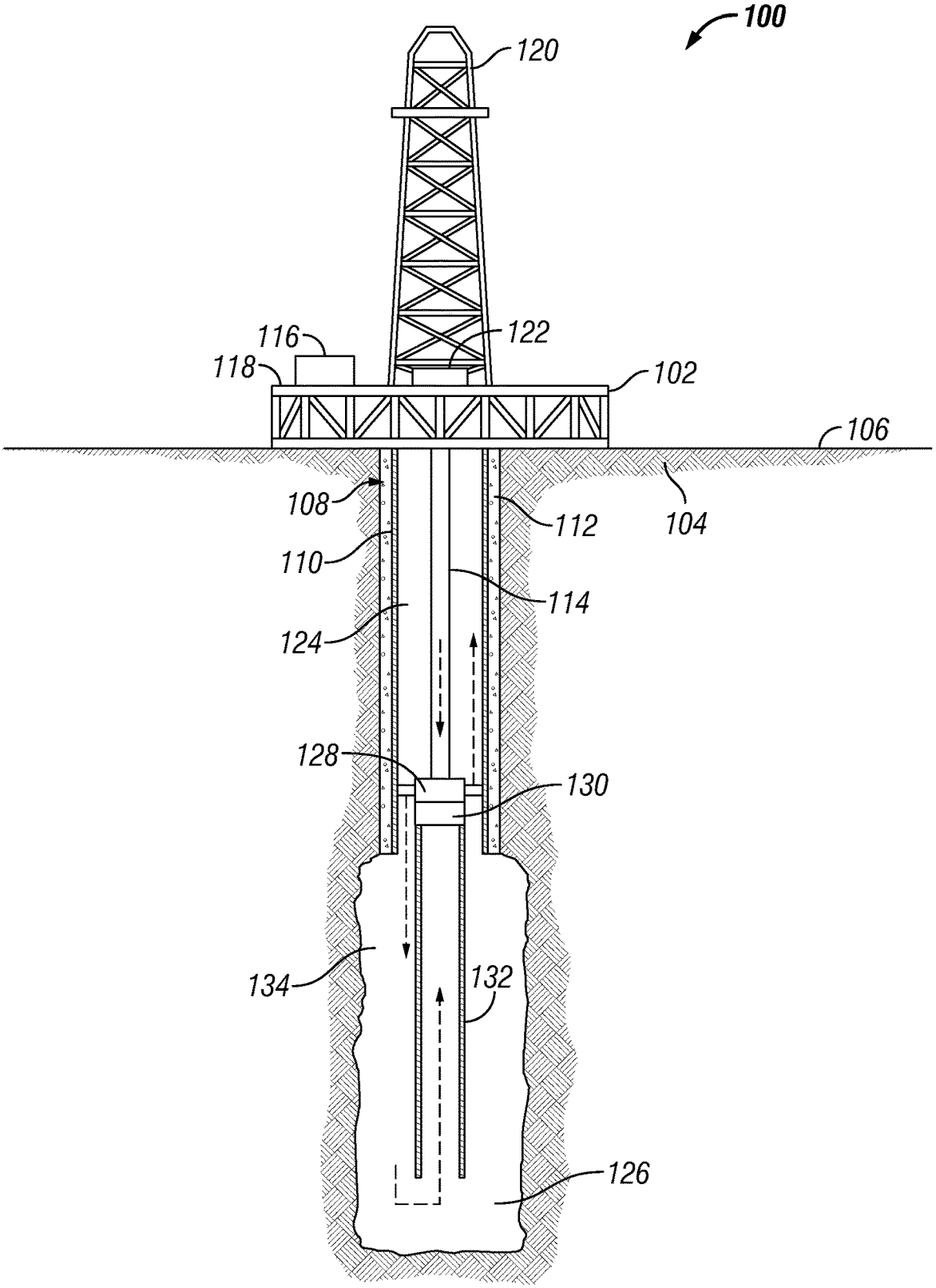
FIG. 1 shows an elevation view of a well system undergoing reverse circulation using a crossover tool, according to one or more embodiments.

FIG. 1 shows an elevation view of a well system 100 with a liner casing 132 undergoing reverse circulation using a crossover tool 128, in accordance with one or more embodiments. As shown, the system 100 includes a rig 102 centered over a subterranean oil or gas formation 104 located below the earth's surface 106. A wellbore 108 extends through the various earth strata including formation 104. The rig 102 includes a work deck 118 that supports a derrick 120. The derrick 120 supports a hoisting apparatus 122 for raising and lowering pipe strings such as a tubing string 114. A pump 116 may be located on the work deck 118 and is capable of pumping a variety of fluids, such as cementing material, into the well, through the tubing string 114. The pump 116 may include a pressure gauge that provides a reading of back pressure at the pump discharge. An upper casing string 110 is located in the wellbore 108 and held in place by cement 112. The upper casing string 110 defines an upper annulus 124, which provides a return flow path for the cementing material as further described herein.

A liner 132 is suspended within the wellbore 108 by the tubing string 114 and extends further downhole from the upper casing string 110. The liner 132 is coupled to a liner hanger 130, which connects the liner 132 to the tubing string 114. Above the liner hanger 130 and coupled to the tubing string 114 is the crossover tool 128 to control the circulation of fluids downhole. The crossover tool 128 is configured to control the circulation of fluid in the wellbore 108. Specifically, the crossover tool 128 is switchable between enabling reverse circulation and enabling conventional circulation flow through the wellbore 108.

As shown, during a reverse cementing operation for cementing liner 132, a cementing material is pumped, via the pump 116 located at the surface 106, into the pipe 114. The cementing material travels downhole through the tubing string 114 into the crossover tool 128. The cementing material is then directed out of the crossover tool 128 and continues downhole into a lower annulus 134 between the liner 132 and the wellbore 108 towards well bottom 126, thereby cementing the annulus 134. The fluid return path is uphole through the inside of the liner 132 into the crossover tool 128. The crossover tool 128 diverts the uphole flow into the upper annulus 124 to the surface 106. The upper annulus 124 is separated from the lower annulus 134 by the crossover tool 128. Thus, the crossover tool 128 can isolate a reverse circulation flow path downhole to cement the liner 132 and return the cementing material uphole in a conventional flow path through the annulus 124.

The wellbore 108 may be filled with various fluids such as drilling fluid which may be displaced uphole through the upper annulus 124. Drilling fluid has a different density profile than cementing material. For example, the drilling fluid can have a lower density than cementing material. Drilling fluid may be any type of drilling fluid such as a water-based or oil-based drilling fluid. The cementing material used may be any suitable resin or hydraulic cementitious material including, for example only, those comprising calcium, aluminum, silicon, oxygen and/or sulfur which set and harden by reaction with water. Such hydraulic materials may include Portland cements, pozzolana cements, gypsum cements, high aluminum content cements, silica cements and high alkalinity cements.

The crossover tool 128 may also be used to separate fluids in the wellbore 108. For example, the crossover tool 128 may be used to replace the fluid in the lower annulus 134 with a different fluid, such as a different drilling fluid, completion fluid, or treatment fluid.

Figure 2:
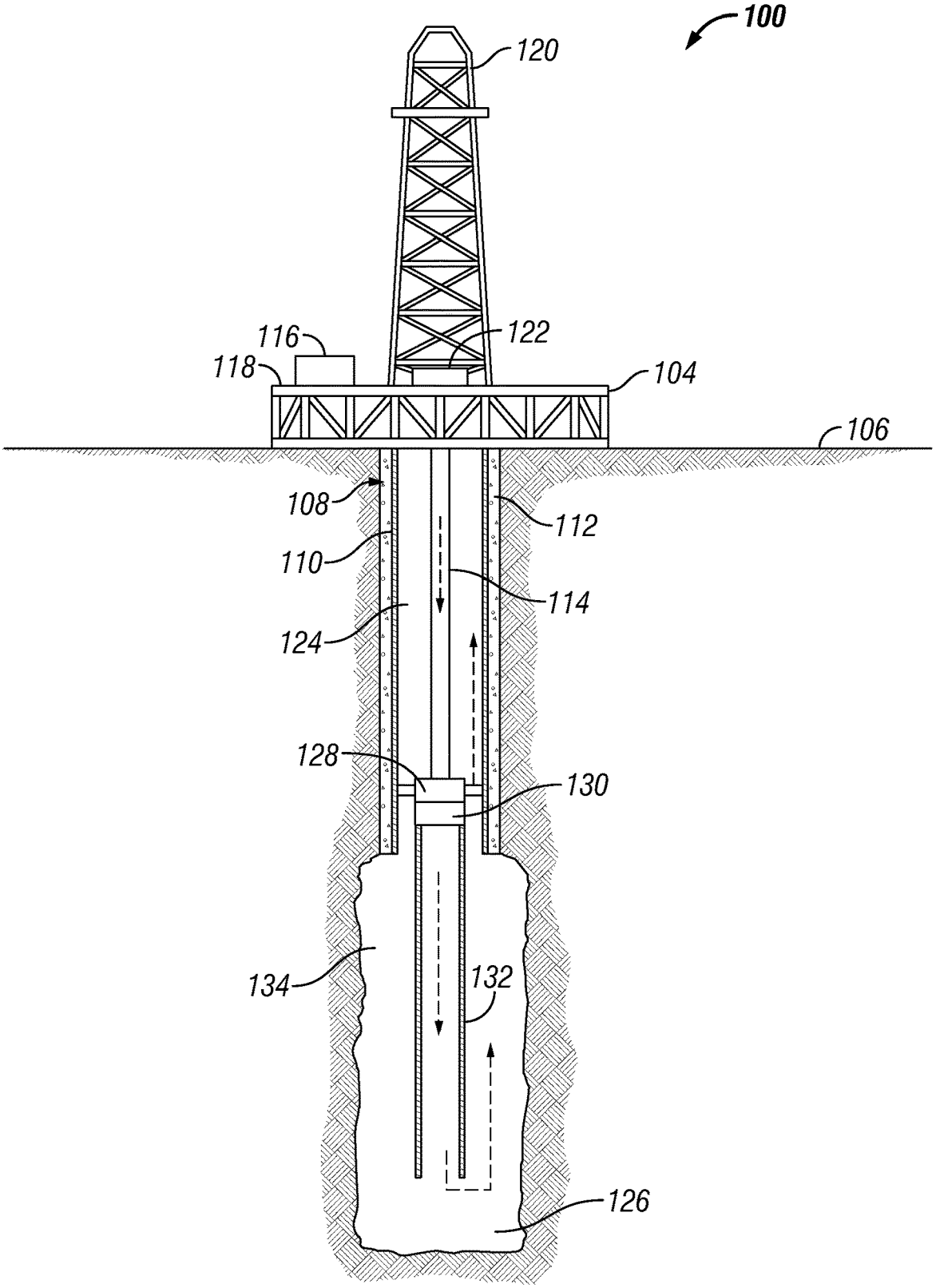
FIG. 2 shows an elevation view of the well system undergoing conventional circulation using the crossover tool, according to one or more embodiments.

FIG. 2 shows a schematic view of the well system 100 operating in a conventional circulation mode as directed by the crossover tool 128, in accordance with one or more embodiments. As shown, downhole flow is delivered through the tubing string 114 and through the inside of the liner 132 towards well bottom 126. The flow path is directed uphole through the lower annulus 134 between the liner 132 and the wellbore 108. The flow path is diverted through the crossover tool 128 into the upper annulus 124 to the surface 106 as further described herein. The crossover tool 128 can be switched back and forth between the conventional circulation mode and the reverse circulation mode multiple times as needed. It should be appreciated that the crossover tool 128 may deliver fluid downhole under a reverse or conventional circulation flow path with any suitable fluid and is not limited to controlling the circulation of cementing material. The flow paths of the crossover tool 218 and other aspects of the crossover tool are described in further detail herein with respect to FIGS. 3-15.

Figure 3:
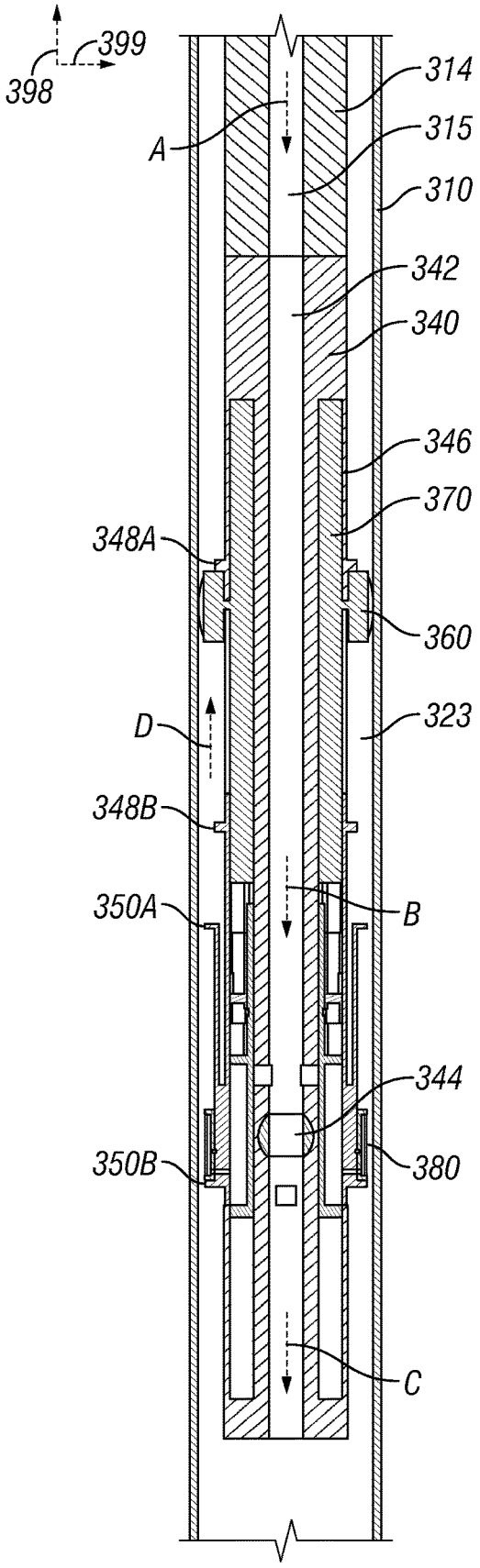
FIG. 3 shows a cross-section view of a crossover tool deployed in a casing string, according to one or more embodiments.

FIG. 3 shows a cross-section view of a crossover tool 328 coupled to a tubing string 314 deployed in a casing string 310, according to one or more embodiments. As shown, the crossover tool 328 is suspended in the casing string 310 by the tubing string 314 and set to allow fluid to flow in a conventional circulation path. That is, fluid flows from the tubing string 314 through a crossover tool bore 342, down to the well bottom (e.g., the well bottom 126 of FIG. 1), and returns to the surface via an annulus 323 as indicated by arrows A-D. It should be appreciated that the casing string 310 is exemplary and the crossover tool 328 may deployed in any suitable tubular, tubular string, wellbore, fluid conveyance device, or the like to control the circulation of fluid.

The crossover tool 328 includes a tool body 340, a drag block assembly 360, a sleeve 370, and a packer assembly 380. A bore 342 runs through the tool body 340 and is in fluid communication with a tubing string bore 315 to provide a flow path through the crossover tool 328. A valve 344 intersects the bore 342 to control the flow of fluid through the crossover tool 328. As shown, the valve 344 is open allowing fluid to flow through the crossover tool 328 in a conventional circulation path.

The sleeve 370 is housed in an annular cavity 346 formed in the tool body 340 and can move axially in the cavity 346 (e.g., along a y-axis 398) based on the drag block assembly's 360 position with respect to collars 348A, 348B. As shown, the collars 348A, 348B are separated along the longitudinal axis of the tool body 340. The distance separating the collars 348A, 348B defines in part the range of axial movement that can be applied to the sleeve 370 in the cavity 346. Additionally, with the valve 344 coupled to the sleeve 370 through the tool body 340, the valve 344 can be actuated by the axial movement of tool body 340 relative to the sleeve 370.

The drag block assembly 360 is coupled to the sleeve 370 through the tool body 340 and positioned between collars 348A, 348B. As the crossover tool 328 is run into the casing string 310, the drag block assembly 360 engages the casing string 310 to maintain engagement with the uppermost collar 348A, which in turn keeps the valve 344 in the open position as further described herein.

The packer assembly 380 is coupled to the tool body 340 between collars 350A, 350B. To set the packer assembly 380, fluid in the crossover tool 328 can be diverted from the bore 342 to the packer assembly 380 to expand or inflate the packer assembly 380, creating a fluid barrier in the annulus 323, and thus, defining an upper annulus and a lower annulus as described further herein. As shown, the packer assembly 380 is not set and allows fluid to flow through the annulus 323 in a conventional circulation path. In one or more embodiments, the packer assembly 380 can be kept in this unset mode while the crossover tool 328 is being deployed to a wellbore position where reverse cementing is needed to set a liner in the well.

In the following discussion, reference may be made to various directions or axes, such as a y-axis or direction 398 and an x-axis or direction 399, as represented schematically on FIGS. 3, 8-11, 14 and 15. It should be appreciated that these axes are in relation to the orientation of the crossover tool 328 and not set axes.

Figure 4:
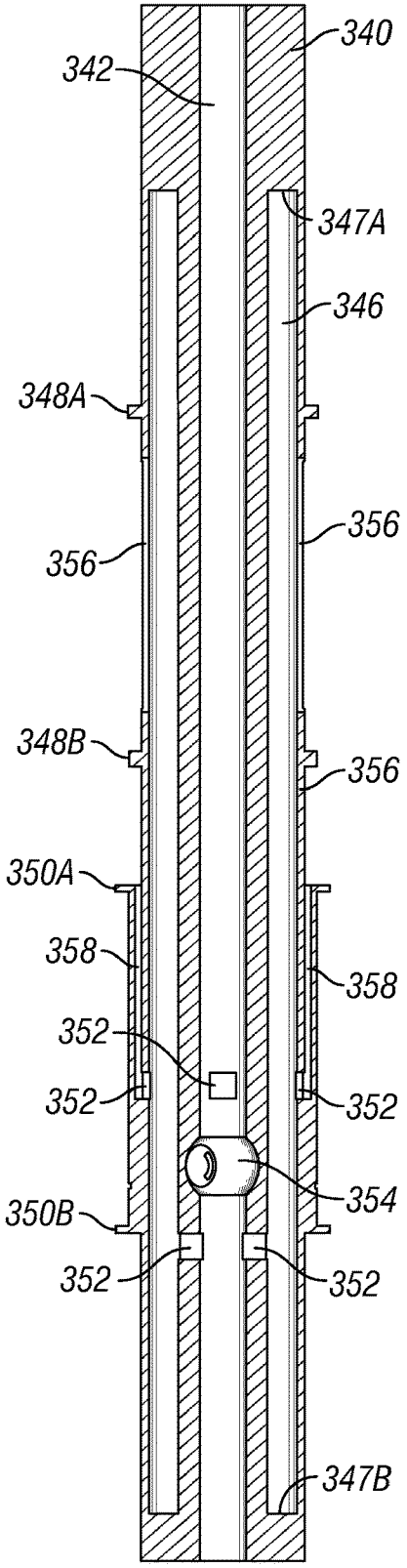
FIG. 4 shows a cross-section view of a tool body included in the crossover tool of FIG. 3, according to one or more embodiments.

FIG. 4 shows a cross-section view of the tool body 340, according to one or more embodiments. As shown, the tool body 340 includes the annular cavity 346 wherein the sleeve 370 can move axially between the ends 347A, B of the cavity 346. Additionally, the tool body 340 includes ports 352 and channels 358 to provide fluid communication paths for reverse circulation or conventional circulation as further described herein. A cavity 354 is formed in the tool body 340 to hold the valve 344 (FIG. 3), allowing the valve 344 to rotate and control the flow of fluid through the crossover tool 328 as further described herein. Slots 356 are formed in the tool body 340 and provide openings to allow the tool body to axially move relative to the drag block assembly 360 as it engages the casing string 310 (FIG. 3).

Figure 5A:
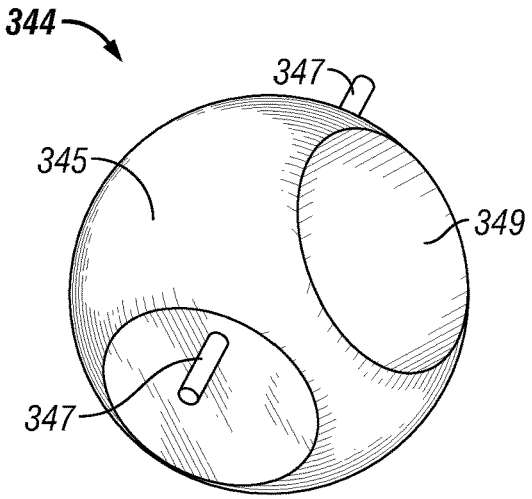
FIG. 5A shows an axonometric view of a valve included in the crossover tool of FIG. 3, according to one or more embodiments.

FIG. 5A shows an axonometric view of the valve 344, in accordance with one or more embodiments. As shown, the valve 344 includes a ball valve 345 with two pins 347 extending radially outward from the ball valve 345. The ball valve includes a bore 349 to control the flow of fluid through the valve 344. The pins 347 extend through the tool body 340 in the cavity 354 and are received in the sleeve 370 such that the axial movement of the sleeve 370 rotates the ball valve 345 to either a closed position or an open position.

Figure 5B:
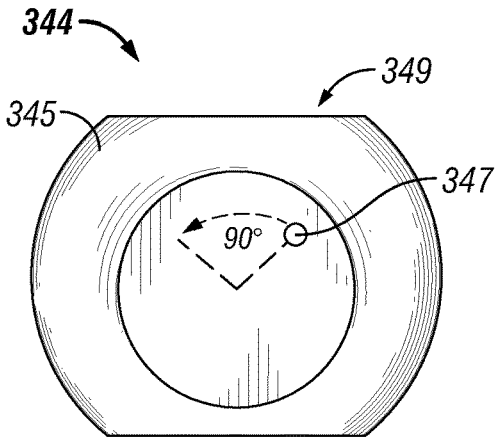
FIG. 5B shows a cross-section view of the valve of FIG. 5A, according to one or more embodiments.

FIG. 5B shows a cross-section view of the valve 344, in accordance with one or more embodiments. As shown, the ball valve 344 can be rotated on the pins 347 by a quarter-turn (e.g., 90°) to switch from the open position to the closed position or vice-versa. In one or more embodiments, the valve 344 can include any suitable device (e.g., a gate valve) to regulate the flow of fluid through the crossover tool 328 based on the rotational movement applied to the valve 344 from axial movement of the tool body 340 relative to the sleeve 370.

Figure 6A:
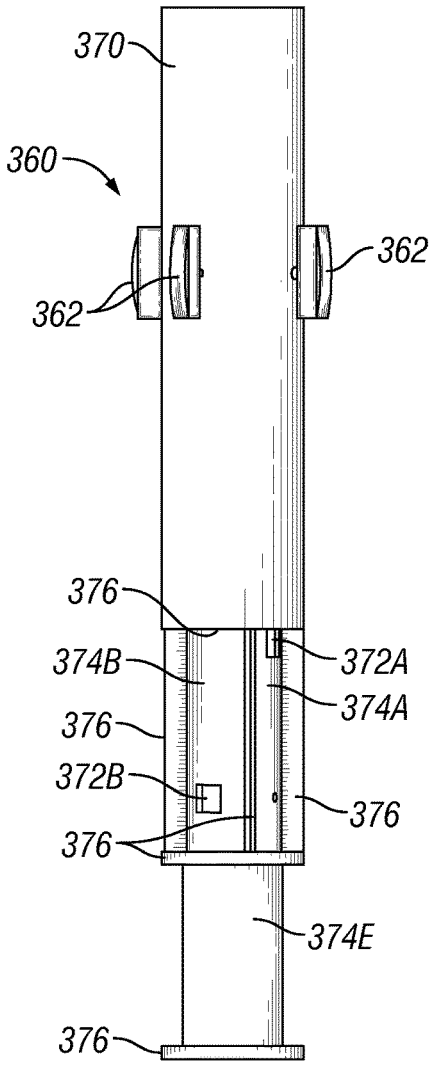
FIGS. 6A and B show axonometric views of a sleeve included in the crossover tool of FIG. 3, according to one or more embodiments.
Figure 6B:
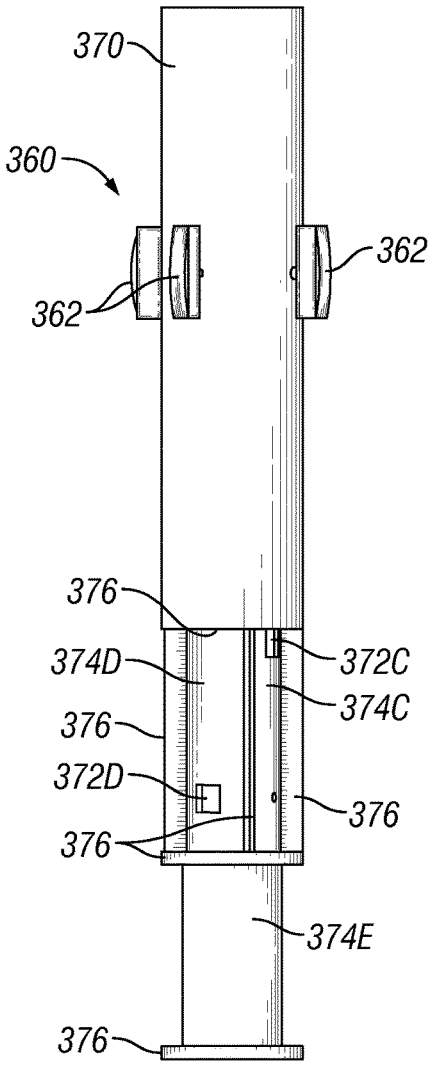

FIGS. 6A and B show axonometric views of the sleeve 370 at different azimuthal orientations about the longitudinal axis of the sleeve 370, according to one or more embodiments. FIG. 6B shows the other side of the sleeve 370 relative to FIG. 6A such that the sleeve 370 in FIG. 6A is turned 180° about the longitudinal axis of the sleeve 370 to provide the side of the sleeve 370 depicted in FIG. 6B. As shown in FIGS. 6A and B, the sleeve 370 includes ports 372A-D and channels 374A-E to direct the flow of fluid through the crossover tool 328. The channels 374A-E are divided by walls 376, which define the channels 374A and C for delivering fluid in a first direction and the channels 374B, D, and E for delivering fluid in a second direction opposite the first as further described herein. It should be understood that the sleeve 370 can include any suitable number of channels 374A-E to direct the flow of fluid through the crossover tool 328.

As shown, the drag block assembly 360 is coupled to the sleeve 370 and includes spring-loaded buttons 362 (e.g., carbide buttons) azimuthally separated around the sleeve 370. The drag block assembly 360 may include a mechanism with springs that apply an outward radial force to enable the buttons 362 to drag along the inner diameter of the casing string 310 (FIG. 3) and exert an axial force that allows the sleeve 370 of the crossover tool 328 to be manipulated in an axial direction. The drag block assembly 360 engages the casing string 310 (FIG. 3) to create friction and resist axial movement as the tool body 340 is moved within the casing string 310. The sleeve 370 also resists axial movement as the sleeve 370 is coupled to the drag block assembly 360. Thus, the sleeve 370 can be positioned in the annular cavity 346 from the axial movement of the tool body 340 as the drag block assembly 360 engages the casing string 310 and resists the axial movement.

Figure 7:
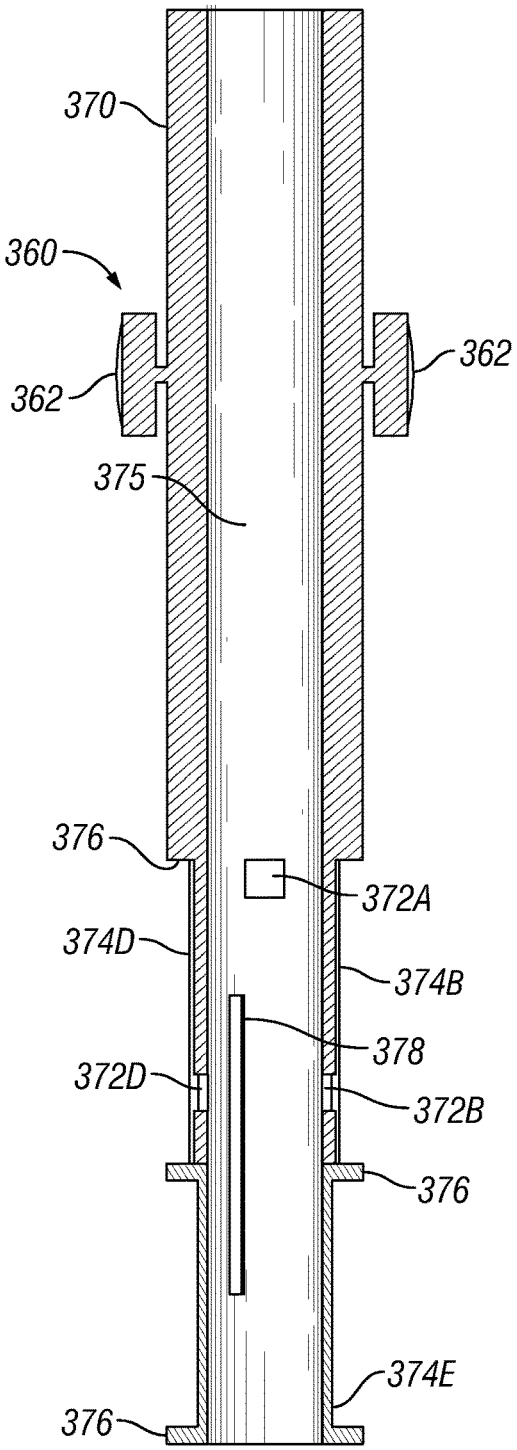
FIG. 7 shows a cross-section view of the sleeve of FIGS. 6A and B, according to one or more embodiments.

FIG. 7 shows a cross-section view of the sleeve 370, according to one or more embodiments. As shown, the sleeve 370 is a tubular device with a slot 378 formed in a sleeve bore 375. The slot 378 receives one of the pins 347 on the valve 344 (FIG. 5A) to actuate the valve 344 as the sleeve 370 is positioned in the annular cavity 346 from the axial movement of the tool body 340.

Figure 8:
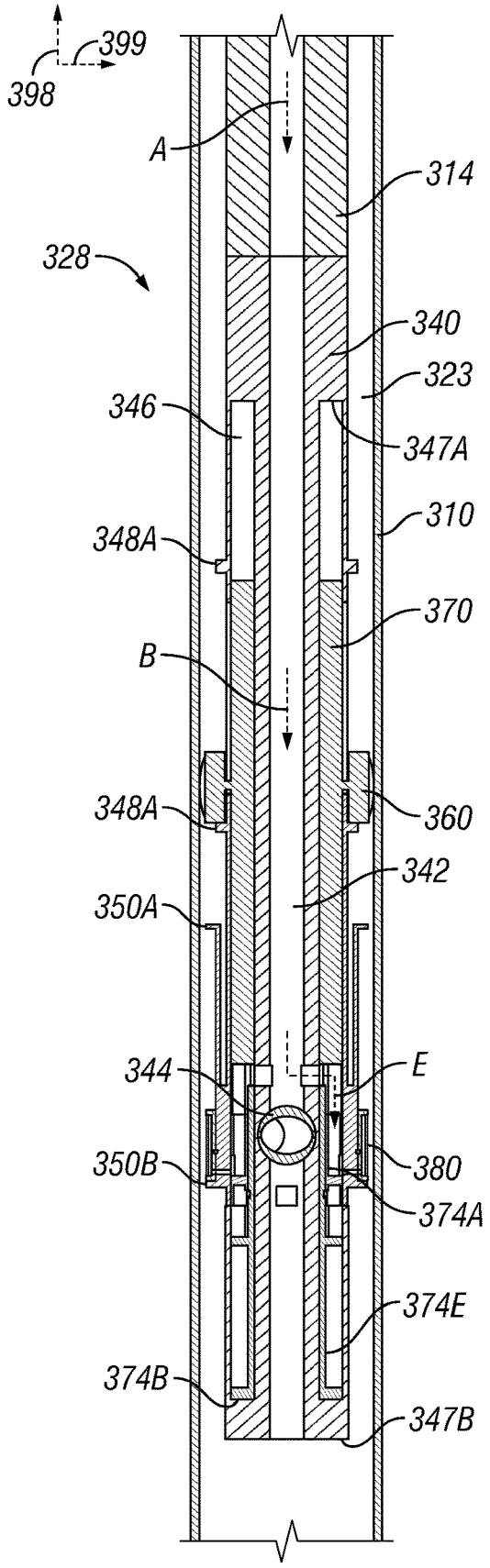
FIG. 8 shows a cross-section view of the crossover tool of FIG. 3 operating in a reverse circulation mode, according to one or more embodiments.

FIG. 8 shows a cross-section view of the crossover tool 328 with the valve 344 in a closed position diverting fluid, in accordance with one or more embodiments. As shown, the fluid is diverted into the channel 374A to expand the packer assembly 380 with the valve 344 in the closed position. As the packer assembly 380 is expanded the packer assembly 380 creates a fluid barrier in the annulus 323 as further described herein. The diverted flow path of the fluid is indicated by arrows A, B, and E. It should be appreciated that, with the channels 374A-E formed as open cavities on the sleeve 370, the tool body 340 and sleeve 370 cooperate to define flow paths through the crossover tool 328.

The valve 344 can be actuated into the open or closed position depending on the position of the sleeve 370 in the annular cavity 346, which can be controlled by the axial movement of the tool body 340 relative to the sleeve 370. For example, the crossover tool 328 may be deployed in the casing string 310 as illustrated in FIG. 3. If the tool body 340 is moved in an upward direction along the y-axis 398 towards the surface, the sleeve 370 resists this axial movement and is repositioned in the annular cavity 346 to engage the annular cavity end 347B as shown in FIG. 8. The valve 344 travels with the tool body 340 and is actuated to a closed position as one of the pins 347 engages the slot 378. To reopen the valve 344, the tool body 340 is lowered until the sleeve 370 engages the opposite annular cavity end 347A. Thus, with the drag block assembly 360 engaged with the casing string 310, the direction of axial movement applied to the tool body 340 controls a rotational movement applied to the valve 344 to actuate the valve 344 in a closed or open position.

Figure 9:
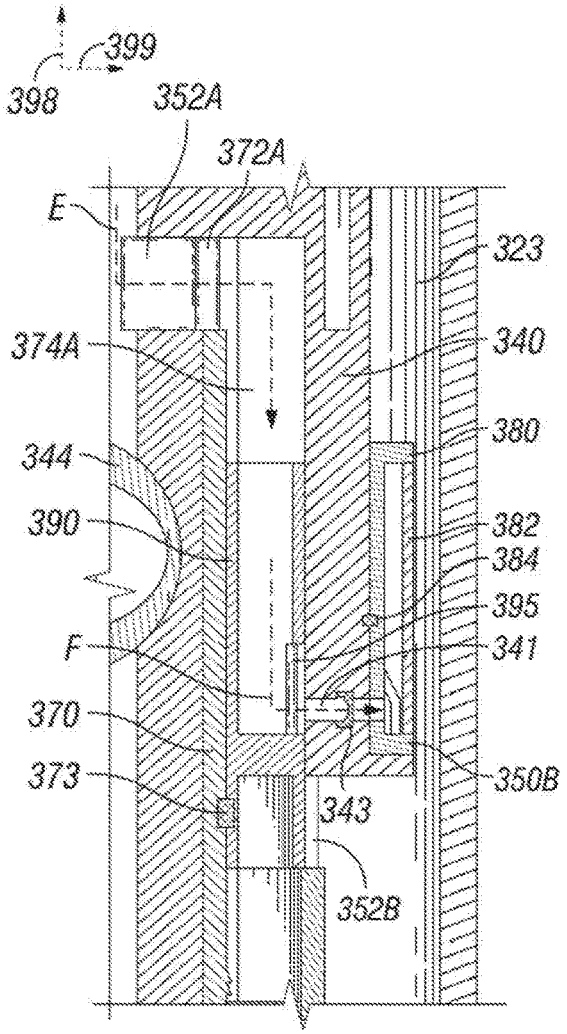
FIGS. 9-11 show cross-section view of the crossover tool of FIG. 3 diverting fluid to set the packer assembly and deliver fluid in a reverse circulation path, in accordance with one or more embodiments.
Figure 10:
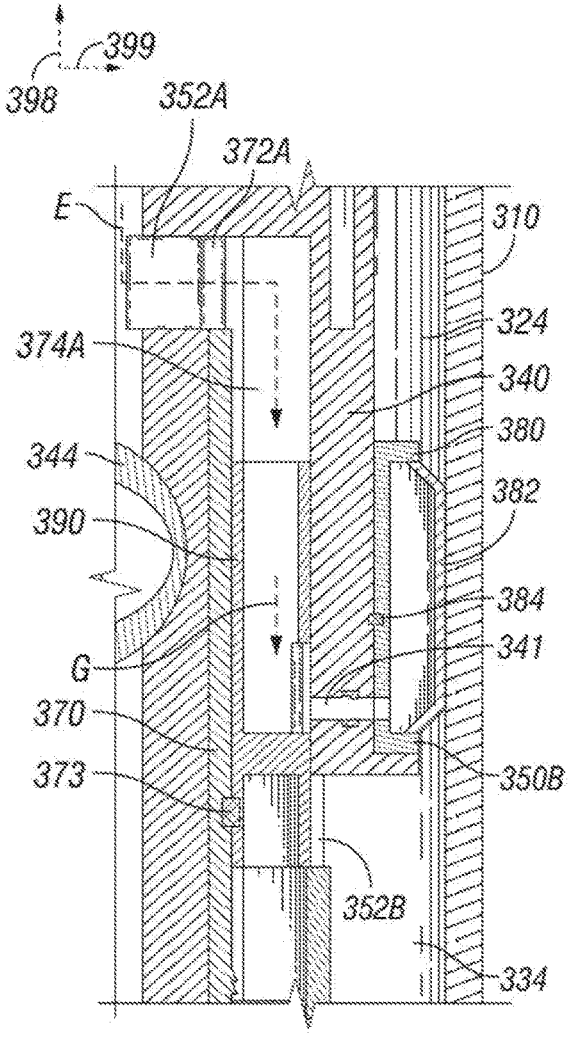
Figure 11:
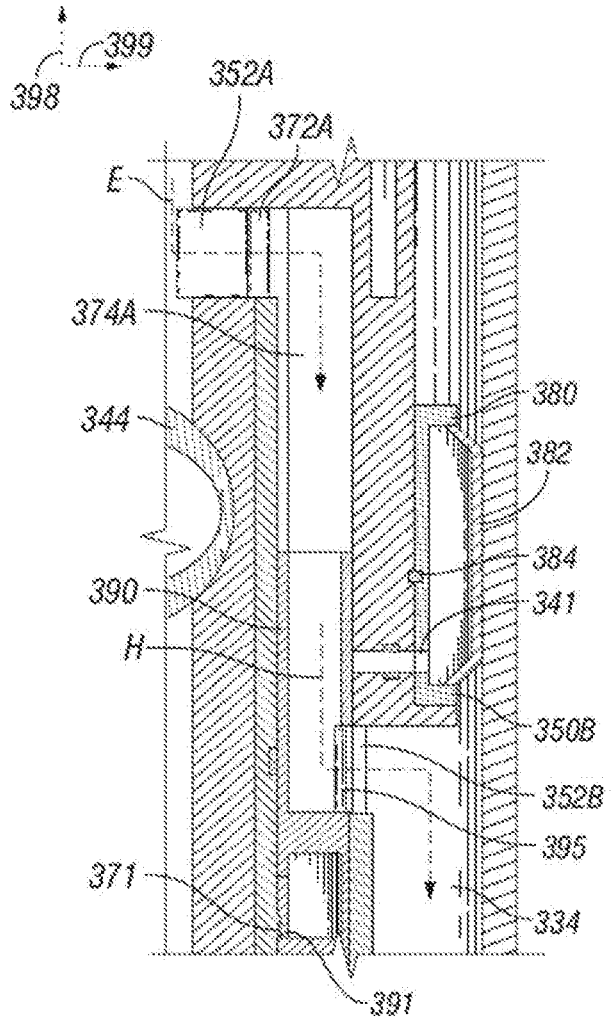

FIGS. 9-11 show cross-section views of the crossover tool 328 diverting fluid to set the packer assembly 380 and deliver the fluid in a reverse circulation path, in accordance with one or more embodiments. As shown in FIG. 9, with the valve 344 closed, pressure increases in the tool bore 342 and diverts fluid above the valve 344 into the channel 374A through ports 352A, 372A as indicated by arrow E. A piston 390 resides in the channel 374A and can operate as a pressure-controlled valve to direct fluid in the channel 374A. For example, the position of the piston 390 in the channel 374A controls if fluid flows into either the packer assembly 380 or the annulus 323. It should be appreciated that a similar piston can reside in channel 374C as fluid is diverted into that channel with the valve 344 closed.

In FIG. 9, the piston 390 is positioned in the channel 374A to divert the fluid through a port 395 to the packer assembly 380 and expand or inflate a bladder 382 on the packer assembly 380 as indicated by arrow F. The fluid is diverted into a port 341 in fluid communication with the packer assembly 380 through the sleeve 370 and tool body 340. A rupture disk 343 may be positioned inside the port 341 to communicate fluid to the packer assembly 380 once a threshold pressure is reached in the channel 374A. For example, the rupture disk 343 can be included to prevent premature expansion of the packer assembly 380 while the crossover tool 328 is being run into the casing string 310. The packer assembly 380 can be releasably coupled to the tool body 340 by a shear pin 384 to maintain alignment and fluid communication between the port 341 and the packer assembly 380.

As shown in FIG. 10, the bladder 382 is expanded radially outward relative to the tool body 340 and engages the casing string 310. With the bladder 382 expanded, the packer assembly 380 creates a fluid barrier in the casing string 310 to resist fluid communication between an upper annuls 324 and a lower annulus 334.

With the packer assembly 380 set, the crossover tool 328 can control the circulation of fluid in the wellbore. As fluid continues to be delivered from the tubing string 314 (FIG. 3) as indicated by arrows E and G, pressure begins to build in the channel 374A, which can move the piston 390 to provide a flow path for reverse circulation. Additionally, or optionally, a shear pin 373 is coupled to the piston 390 and channel 374A to allow the piston 390 to move once a threshold pressure is reached in the channel 374A.

In FIG. 11, the pressure in the channel 374A reached the threshold pressure to disable or shear the shear pin 373 attached to the piston, causing the piston 390 to move downward (e.g., along the y-axis 398) and allow fluid to flow through a port 352B into the lower annulus 334 as indicated by arrows E and H. Additionally, or optionally, the piston 390 serves as a fluid barrier between the channel 374A and the packer assembly 380, such as resisting fluid communication through the port 341, thus, sealing the packer assembly 380 and preventing it from deflating or contracting. This ensures the packer assembly 380 remains engaged with the casing string 310 to allow the crossover tool 328 to control the fluid circulation in the wellbore. In one or more embodiments, the piston 390 can include saw teeth 391 that engage with other saw teeth 371 in the channel 374A to secure the piston 390 in place. Additionally, or optionally, the piston 390 can include any suitable fastening device to secure the piston 390 in place in the channel 374A once the piston 390 is axially displaced as shown in FIG. 11.

Figure 12:
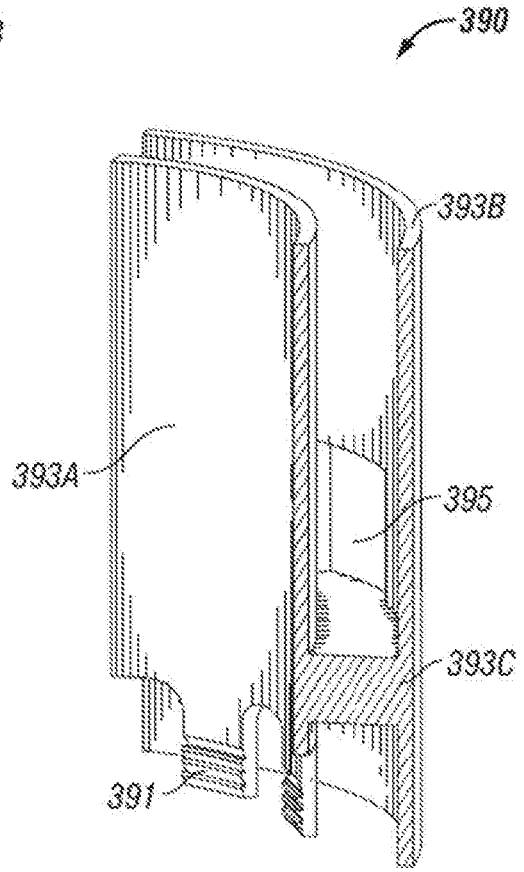
FIG. 12 shows an axonometric view of a piston used to divert fluid in a sleeve channel, in accordance with one or more embodiments.

FIG. 12 shows an axonometric view of the piston 390 used to divert fluid in the sleeve channels 374A and C, in accordance with one or more embodiments. The piston 390 includes an interior wall 393A and an exterior wall 393B joined by an internal wall 393C to catch and direct fluid as the fluid flows through a sleeve channel (e.g., the channels 374A and 374C). On the exterior wall 393B, a port 395 is positioned to direct fluid flow through the piston 390, for example into either the packer assembly 380 or the lower annulus 334. It should be appreciated that the port 395 can be in fluid communication with either the packer assembly 380 or the lower annulus 334 depending on the piston's 390 position in the channel 374A. The saw teeth 391 or any other suitable fastening device can be included to secure the piston in place inside the crossover tool 328 once the piston 390 is axially displaced in the sleeve channel. It should be appreciated that the crossover tool 328 can include any number of suitable pistons depending on the number of channels used to divert fluid into a lower annulus.

Figure 13:
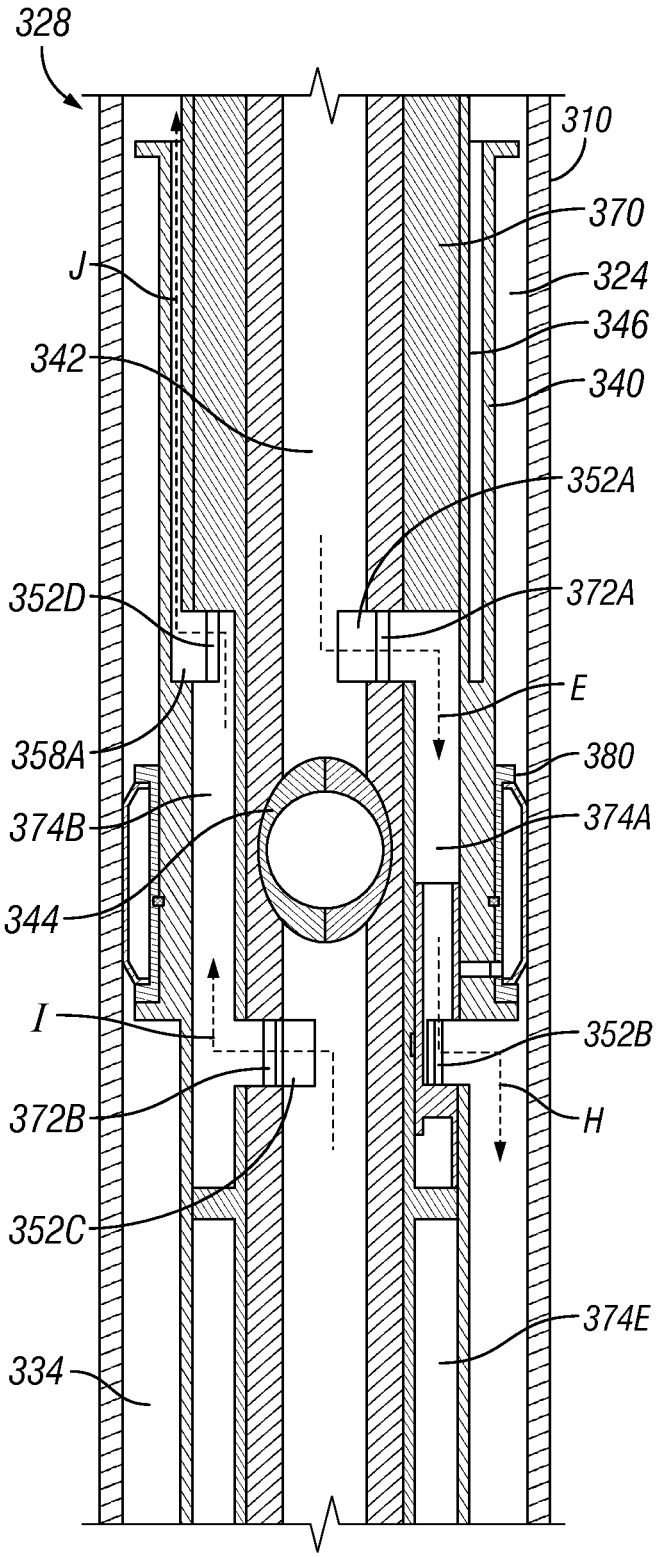
FIG. 13 shows an enlarged cross-section view of the crossover tool of FIG. 3 operating in a reverse circulation mode, according to one or more embodiments.

FIG. 13 shows an enlarged cross-section view of the crossover tool 328 directing fluid in a reverse circulation flow path and returning the fluid in a conventional flow path, in accordance with one or more embodiments. As shown, the fluid flows through the crossover tool bore 342 and is diverted (as indicated by arrow E) by the valve 344 set in a closed position by the sleeve's 370 position in the annular cavity 346. With the packer assembly 380 set and the piston 390 positioned to be in fluid communication with the port 352B, the fluid flows through the channel 374A into the lower annulus 334 as indicated by arrow H. As the fluid reaches the bottom of the well (e.g., the well bottom 126 of FIG. 1), the fluid returns to the crossover tool bore 342 through the liner casing bore (not shown). The fluid flowing through the crossover tool bore 342 below the valve 344 is diverted (as indicated by arrow I) by the valve 344 into the channel 374B in the sleeve 370 through ports 352C, 372B. The fluid flows through the channel 374B into the upper annulus 324 through ports 352D and the channel 358A (as indicated by arrow J) to be delivered to the surface in a conventional circulation flow path. Thus, the packer assembly 380 isolates the reverse circulation flow path produced in the lower annulus 334 from the conventional circulation flow path produced in the upper annulus 324. It should be appreciated that FIGS. 9-11, and 13 are cross-section views and that the crossover over tool 328 can include any suitable number of channels to produce the reverse circulation flow path in the lower annulus 334 and the conventional circulation flow path in the upper annulus 324.

Figure 14:
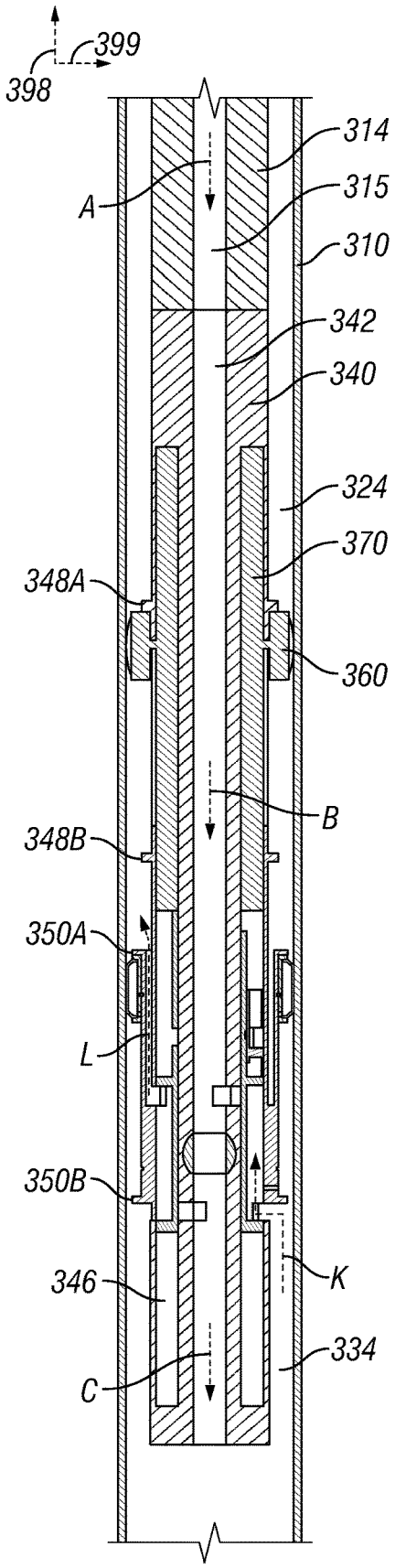
FIGS. 14 and 15 show cross-section views of the crossover tool of FIG. 3 operating in a conventional circulation mode with the packer assembly set, according to one or more embodiments.

FIG. 14 shows a cross-section view of the crossover tool 328 operating in a conventional circulation mode after switching from a reverse circulation mode as illustrated in FIG. 13, in accordance with one or more embodiments. As shown, with the packer assembly 380 set, the crossover tool 328 provides an alternative flow path to bypass the packer assembly 380 and deliver fluid in a conventional circulation flow path. The crossover tool 328 is moved in a downward direction relative to the y-axis 398 to position the sleeve 370 in the annular cavity 346 and open the valve 344. The drag block assembly 360 engages the collar 348A to return the valve 344 in the open position.

As shown, the packer assembly 380 engages the collar 350A. As the packer assembly 380 engages the casing string 310, the packer assembly 380 resists axial movement and allows the tool body 340 to slide between the collars 350A and 350B as the tool body 340 is displaced in the casing string 310. Thus, the packer assembly 380 can remain stationary relative to the tool body 340 as the tool body 340 is moved in a downward direction (e.g., along the y-axis 398), while maintaining the fluid barrier between the upper and lower annuluses 324, 334.

As fluid is delivered to the bottom of the wellbore (e.g., the well bottom 126 of FIG. 2) through the liner bore (e.g., the liner casing 132 of FIG. 2), the fluid returns to the surface through the lower annulus 334. However, with the packer assembly 380 set, a fluid barrier remains between the upper annulus 324 and the lower annulus 334. Pressure builds in the lower annulus 334 such that fluid is diverted into the crossover tool 328 (as indicated by arrow K) and delivered into the upper annulus 324 as indicated by arrow L. Thus, the crossover tool 328 provides a flow path that bypasses the packer assembly 380 to deliver fluid in a conventional circulation flow path.

Figure 15:
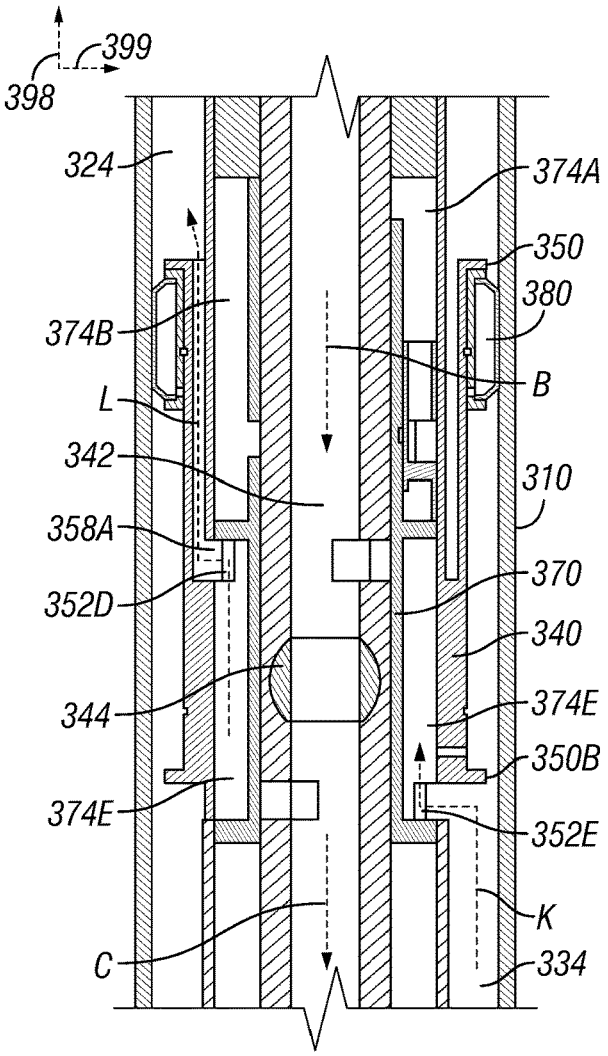

FIG. 15 shows an enlarged cross-section view of the crossover tool 328 set in a conventional circulation mode after switching from a reverse circulation mode as illustrated in FIG. 13, in accordance with one or more embodiments. As shown, the sleeve 370 is positioned so that the crossover tool 328 is in fluid communication with the lower annulus 334 and upper annulus 324 via ports 352E and 352D and channels 374E and 358A. As pressure builds in the lower annulus 334 from the fluid barrier created by the packer assembly 380, fluid flows into the channel 374E through port 352E. The channel 374E is in fluid communication with the upper annulus 324 via the port 352D and channel 358A, and thus, the fluid is directed to the upper annulus 324 through the channel 358A. With the sleeve 370 in the position shown in the annular cavity 346, the crossover tool 328 delivers the return fluid in a conventional circulation path as indicated by arrows K and L. It should be appreciated that the crossover tool 328 may include additional or alternative channels to switch to a conventional circulation flow path once the packer assembly 380 is set.

As described herein with respect to FIGS. 3-15, it should be appreciated that the crossover tool 328 provides a mechanism to switch between reverse circulation and conventional circulation flow paths once the packer assembly 380 is set. That is, the crossover tool 328 can continue to switch between reverse circulation and conventional flow paths as many times is necessary once the packer assembly 380 is set.

In addition to the embodiments described above, many examples of specific combinations are within the scope of the disclosure, some of which are detailed below:

Example 1: A system for controlling fluid circulation in a wellbore intersecting a subterranean earth formation, comprising:
- a tubing string locatable in the wellbore such that an annulus is formed between the tubing string and the wellbore; and
- a crossover tool, comprising:
  - a tool body comprising a bore in fluid communication with the tubing string and a valve in the bore;
  - a sleeve located in the tool body configured to control the valve based on the axial position of the sleeve in the tool body;
  - a drag block assembly coupled to the sleeve through the tool body and configured to engage the wellbore and resist axial movement of the sleeve relative to the tool body; and
  - a packer assembly coupled to the tool body and configured to create a fluid barrier in the annulus, the barrier dividing the annulus into an upper annulus and a lower annulus.

Example 2: The system of example 1, wherein the valve includes a pin extending through the body and engaging a groove on the sleeve so as to rotate the valve when the body is axially moved relative to the sleeve.

Example 3: The system of example 1, wherein the sleeve is located in an annular cavity formed in the tool body.

Example 4: The system of example 1, wherein the crossover tool comprises channels configured to provide flow paths through the crossover tool.

Example 5: The system of example 1, wherein the crossover tool further comprises a piston located between the sleeve and the tool body and comprising a port, wherein when the valve is closed, fluid is flowable through the port to expand the packer assembly and axially move the piston to allow fluid to flow into the lower annulus.

Example 6: The system of example 5, wherein the crossover tool includes a rupture disk configured to block a fluid flow to expand the packer assembly until a threshold pressure is reached.

Example 7: The system of example 4, wherein the channels comprise:
- a channel to divert the fluid in the internal bore above the valve, when the valve is closed, into the lower annulus; and
- another channel to divert the fluid in the internal bore below the valve, when the valve is closed, to the upper annulus.

Example 8: The system of example 1, wherein the valve is configured to close from axial movement of the tool body relative to the sleeve in a first direction and open from axial movement of the tool body in a second direction opposite the first.

Example 9: The system of example 1, wherein the tool body is axially moveable relative to the packer assembly when the barrier is created by the packer assembly.

Example 10: The system of example 1, wherein the tubing string comprises a liner, and the crossover tool is configured to allow reverse cementing of the liner in the lower annulus.

Example 11: A method of controlling fluid circulation in a wellbore intersecting a subterranean earth formation, wherein a tubing string is located in the wellbore and comprises a bore such that an annulus is formed between the tubing string and the wellbore, comprising:
- delivering fluid through the tubing string bore;
- axially moving a body relative to a sleeve on the tubing string in a first direction to close a valve in the bore and divert the fluid above the valve into a channel in fluid communication with a packer assembly;
- expanding the packer assembly with the diverted fluid to create a fluid barrier in the annulus, the barrier dividing the annulus into an upper annulus and a lower annulus;
- moving a piston with the diverted fluid to allow the fluid to flow from the channel to the lower annulus;
- returning the fluid into the tubing string bore from the lower annulus; and
- diverting the fluid around the closed valve through another channel to allow the returned fluid to flow from the bore below the closed valve to the upper annulus.

Example 12: The method of example 11, further comprising:
- axially moving the body relative to the sleeve in a second direction opposite to the first to open the valve in the bore;
- delivering the fluid into the lower annulus through a distal end of the bore; and bypassing the fluid in the lower annulus around the packer assembly to the upper annulus to circulate the fluid in a conventional circulation mode.

Example 13: The method of example 12, further comprising:
- axially moving the body relative to the sleeve in the first direction to close the valve in the bore, such that the expanded packer allows the body to move relative to the packer; and
- diverting the fluid in the bore to the lower annulus to circulate the fluid in a reverse circulation mode.

Example 14: The method of example 11, wherein expanding the packer comprises rupturing a rupture disk at a threshold pressure to allow the diverted fluid to expand the packer.

Example 15: The method of example 11, wherein the fluid includes at least one of a cementing fluid, a drilling fluid, a completion fluid, and a treatment fluid.

Example 16: The method of example 11, further comprising cementing a portion of the tubing string in the wellbore with the diverted fluid in the lower annulus.

Example 17: A crossover tool for controlling fluid circulation in a wellbore intersecting a subterranean earth formation, comprising:
- a tool body locatable in the wellbore comprising:
  - a bore; and
  - a valve in the bore;
- a sleeve located in the body configured to control the valve based on the axial position of the sleeve in the tool body;
- a drag block assembly coupled to the sleeve through the body and configured to engage the wellbore and resist axial movement of the sleeve relative to the tool body; and a packer assembly coupled to the tool body and configured to create a fluid barrier in the wellbore, the barrier dividing the wellbore into an upper annulus and a lower annulus.

Example 18: The tool of example 17, wherein the valve includes a pin extending through the body and engaging a groove on the sleeve so as to rotate the valve when the body is axially moved relative to the sleeve.

Example 19: The tool of example 17, further comprises a piston located between the sleeve and the tool body and comprising a port configured, wherein when the valve is closed, fluid is flowable to expand the packer assembly and axially move the piston to allow fluid to flow into the lower annulus.

Example 20: The tool of example 17, wherein the valve is configured to close from axial movement of the tool body relative to the sleeve in a first direction and open from axial movement of the tool body in a second direction opposite the first.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A system for controlling fluid circulation in a wellbore intersecting a subterranean earth formation and comprising a wellbore wall surface, comprising:

a tubing string locatable in the wellbore such that an annulus is formed between the tubing string and the wellbore; and a crossover tool coupled to the tubing string, the crossover tool comprising:

a tool body comprising a bore in fluid communication with the tubing string;

a valve in the bore;

a sleeve located in the tool body configured to control the valve based on the axial position of the sleeve in the tool body;

a drag block assembly coupled to the sleeve and configured to contact with the wellbore wall surface and resist axial movement of the sleeve within the wellbore;

a packer assembly coupled to the tool body and configured to create a fluid barrier in the annulus, the barrier dividing the annulus into an upper annulus and a lower annulus; and wherein:

contact of the drag block assembly with the wellbore wall surface and movement of the tool body causes the sleeve to move relative to the tool body and actuate the valve;

the crossover tool is configured to receive the fluid from the tubing string uphole of the crossover tool, to flow the fluid into the lower annulus, to receive return fluid from the tubing string downhole of the crossover tool, and to flow the return fluid into the upper annulus when the valve is closed; and the crossover tool is configured to receive the fluid from the tubing string uphole of the crossover tool, to flow the fluid into the tubing string downhole of the crossover tool, to receive the return fluid from the lower annulus, and to flow the return fluid into the upper annulus when the valve is open.

2. The system of claim 1, wherein the valve includes a pin extending through the body and engaging a groove on the sleeve so as to rotate the valve when the body is axially moved relative to the sleeve.

3. The system of claim 1, wherein the sleeve is located in an annular cavity formed in the tool body.

4. The system of claim 1, wherein the crossover tool comprises channels configured to provide flow paths through the crossover tool.

5. The system of claim 4, wherein the channels comprise: a channel to divert the fluid in the internal bore above the valve, when the valve is closed, into the lower annulus; and another channel to divert the fluid in the internal bore below the valve, when the valve is closed, to the upper annulus.

6. The system of claim 1, wherein the crossover tool further comprises a piston located between the sleeve and the tool body and comprising a port, wherein when the valve is closed, fluid is flowable through the port to expand the packer assembly and axially move the piston to allow fluid to flow into the lower annulus.

7. The system of claim 6, wherein the crossover tool includes a rupture disk configured to block a fluid flow to expand the packer assembly until a threshold pressure is reached.

8. The system of claim 1, wherein the valve is configured to close from axial movement of the tool body relative to the sleeve in a first direction and open from axial movement of the tool body in a second direction opposite the first.

9. The system of claim 1, wherein the tool body is axially moveable relative to the packer assembly when the barrier is created by the packer assembly.

10. The system of claim 1, wherein the tubing string comprises a liner, and the crossover tool is configured to allow reverse cementing of the liner in the lower annulus.

11. A method of controlling fluid circulation in a wellbore intersecting a subterranean earth formation, wherein a tubing string is located in the wellbore and comprises a bore such that an annulus is formed between the tubing string and the wellbore, comprising:

delivering fluid through the tubing string bore to a crossover tool coupled to the tubing string;

contacting a drag block coupled to a sleeve of the crossover tool with a wellbore wall surface within the wellbore to resist axial movement of the sleeve within the wellbore;

axially moving the sleeve relative to a body of the crossover tool in a first direction to close a valve of the crossover tool in a bore of the crossover tool and divert the fluid above the valve into a channel of the crossover tool in fluid communication with a packer assembly;

expanding the packer assembly with the diverted fluid to create a fluid barrier in the annulus, the barrier dividing the annulus into an upper annulus and a lower annulus;

moving a piston with the diverted fluid to allow the fluid to flow from the channel to the lower annulus;

returning the fluid to the crossover tool through the tubing string bore downhole of the crossover tool;

axially moving the sleeve relative to the body in a second direction opposite to the first to open the valve;

delivering the fluid into the lower annulus through the tubing string bore downhole of the crossover tool; and returning the fluid from the lower annulus to the crossover tool; and flowing the returned fluid from the crossover valve into the upper annulus.

12. The method of claim 11, further comprising:

axially moving the sleeve relative to the body in the first direction to close the valve in the bore, such that the expanded packer allows the body to move relative to the packer; and diverting the fluid in the bore to the lower annulus to circulate the fluid in a reverse circulation mode.

13. The method of claim 11, wherein expanding the packer comprises rupturing a rupture disk at a threshold pressure to allow the diverted fluid to expand the packer.

14. The method of claim 11, wherein the fluid includes at least one of a cementing fluid, a drilling fluid, a completion fluid, and a treatment fluid.

15. The method of claim 11, further comprising cementing a portion of the tubing string in the wellbore with the diverted fluid in the lower annulus.

16. A crossover tool for use with a tubular string to control fluid circulation in a wellbore intersecting a subterranean earth formation and comprising a wellbore wall surface, the crossover tool comprising:

a tool body locatable in the wellbore comprising a bore;

a valve in the bore;

a sleeve located in the body configured to control the valve based on the axial position of the sleeve in the tool body;

a drag block assembly coupled to the sleeve configured to contact with the wellbore wall surface and resist axial movement of the sleeve within the wellbore;

a packer assembly coupled to the tool body and configured to create a fluid barrier in the wellbore, the barrier dividing the wellbore into an upper annulus and a lower annulus; and wherein:

contact of the drag block assembly with the wellbore wall surface and movement of the tool body causes the sleeve to move relative to the tool body and actuate the valve;

the crossover tool is configured to receive the fluid from the tubular string uphole of the crossover tool, to flow the fluid into the lower annulus, to receive return fluid from the tubing string downhole of the crossover tool, and to flow the return fluid into the upper annulus when the valve is closed; and the crossover tool is configured to receive the fluid from the tubular string uphole of the crossover tool, to flow the fluid into the tubing string downhole of the crossover tool, to receive the return fluid from the lower annulus, and to flow the return fluid into the upper annulus when the valve is open.

17. The tool of claim 16, wherein the valve includes a pin extending through the body and engaging a groove on the sleeve so as to rotate the valve when the body is axially moved relative to the sleeve.

18. The tool of claim 16, further comprises a piston located between the sleeve and the tool body and comprising a port configured, wherein when the valve is closed, fluid is flowable to expand the packer assembly and axially move the piston to allow fluid to flow into the lower annulus.

19. The tool of claim 16, wherein the valve is configured to close from axial movement of the tool body relative to the sleeve in a first direction and open from axial movement of the tool body in a second direction opposite the first.

* * * * *